US011184718B2

(12) United States Patent
Voss et al.

(10) Patent No.: US 11,184,718 B2
(45) Date of Patent: Nov. 23, 2021

(54) MINIATURE SPEAKER WITH MULTIPLE SOUND CAVITIES

(71) Applicant: Sonion Nederland B.V., Hoofddorp (NL)

(72) Inventors: Rasmus Voss, Hoofddorp (NL); Koen van Gilst, Hoofddorp (NL); Viktor Klymko, Hoofddorp (NL); Jelle Heuveling, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 22 days.

(21) Appl. No.: 16/668,967

(22) Filed: Oct. 30, 2019

(65) Prior Publication Data

US 2020/0204934 A1 Jun. 25, 2020

(30) Foreign Application Priority Data

Dec. 19, 2018 (EP) ..... 18213900

(51) Int. Cl.
*H04R 17/00* (2006.01)
*H04R 25/00* (2006.01)

(52) U.S. Cl.
CPC ..... *H04R 25/604* (2013.01); *H04R 17/00* (2013.01); *H04R 2201/003* (2013.01); *H04R 2225/023* (2013.01)

(58) Field of Classification Search
CPC ..... H04R 1/24; H04R 17/00; H04R 17/005; H04R 2201/003
See application file for complete search history.

(56) References Cited

U.S. PATENT DOCUMENTS

| | | | |
|---|---|---|---|
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |
| 6,919,519 | B2 | 7/2005 | Ravnkilde |
| 6,930,259 | B1 | 8/2005 | Jorgensen |
| 6,943,308 | B2 | 9/2005 | Ravnkilde |

(Continued)

FOREIGN PATENT DOCUMENTS

| | | | |
|---|---|---|---|
| DE | 102017206766 | † | 4/2017 |
| WO | WO 2016/180280 A1 | | 11/2016 |

OTHER PUBLICATIONS

Tmt30 expertise in audio media, ISBN 978-3-9812830-9-9.†

(Continued)

*Primary Examiner* — Ryan Robinson
(74) *Attorney, Agent, or Firm* — Nixon Peabody LLP

(57) ABSTRACT

The present invention relates to a miniature speaker comprising a plurality of sound generating elements, wherein each sound generating element comprises a sound cavity and a moveable element associated therewith, wherein the moveable element comprises one or more cantilever beams configured to move said moveable element and thus generate sound pressure waves in response to an applied drive signal. The present invention further relates to a receiver assembly comprising the miniature speaker, and a hearing device comprising the receiver assembly.

16 Claims, 12 Drawing Sheets

(56) References Cited

U.S. PATENT DOCUMENTS 6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 Van Doorn
7,088,839 B2 8/2006 Geschiere
7,110,560 B2 9/2006 Stenberg
7,136,496 B2 11/2006 van Halteren
7,142,682 B2 11/2006 Mullenbom
7,181,035 B2 2/2007 van Halteren
7,190,803 B2 3/2007 van Halteren
7,206,428 B2 4/2007 Geschiere
7,221,767 B2 5/2007 Mullenborn
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,039 B2 1/2012 van Halteren
8,116,508 B2 * 2/2012 Xu ..... H04R 17/00 381/396
8,160,290 B2 4/2012 Jorgensen
8,170,244 B2 5/2012 Ryan
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
8,737,674 B2 * 5/2014 Dehe ..... H04R 1/403 381/395
9,391,541 B2 7/2016 Cohen
9,402,137 B2 * 7/2016 Hsu ..... H04R 19/005
9,843,862 B2 * 12/2017 Barzen ..... H04R 3/06
10,097,928 B2 * 10/2018 Rusconi Clerici Beltrami ..... H04R 19/02
10,327,052 B2 * 6/2019 Arevalo Carreno ... H04R 31/00
10,447,238 B2 * 10/2019 Kang ..... H03H 9/13
2005/0190941 A1 9/2005 Yang
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0250897 A1 10/2012 Michel
2012/0250909 A1 10/2012 Grosh
2012/0255805 A1 10/2012 van Halteren
2013/0028451 A1 1/2013 de Roo
2013/0136284 A1 5/2013 van Hal
2013/0142370 A1 6/2013 Engbert
2013/0163799 A1 6/2013 Van Halteren
2013/0195295 A1 8/2013 van Halteren
2015/0350792 A1 12/2015 Grosh
2017/0289674 A1 10/2017 Shi
2020/0087138 A1 * 3/2020 Schenk ..... H04R 19/005
2020/0204934 A1 † 6/2020 Voss
2020/0211521 A1 * 7/2020 Voss ..... H04R 1/403

OTHER PUBLICATIONS

Ehrig, et al., MEMS-Loudspeaker—A Novel Class of Electroacoustic Transducers for Mobile Audio Applications, Nov. 2018, 39th Tonmeistertagung—VDT International Convention.†

* cited by examiner
† cited by third party

MINIATURE SPEAKER WITH MULTIPLE SOUND CAVITIES

CROSS-REFERENCE TO RELATED APPLICATIONS

This application claims the benefit of European Patent Application Serial No. 18213900.6, filed Dec. 19, 2018, which is incorporated herein by reference in its entirety.

FIELD OF THE INVENTION

The present invention relates to miniature speakers with multiple sound cavities. The present invention relates in particular to miniature speakers where the multiple sound cavities are covered by arrays of cantilever beams each having an integrated drive mechanism.

BACKGROUND OF THE INVENTION

It is well established that in conventional miniature speakers for hearing devices, such as receiver-in-canal (RIC) type hearing devices, it is difficult to a reach a sufficient sound pressure level (SPL). The main reason for this being the restricted overall volume of miniature speakers as the restricted overall volume sets a limit to the maximum allowable diaphragm area of the miniature speaker. As a result miniature speakers for RIC type hearing devices often suffer from a poor voltage sensitivity.

Moreover, conventional miniature speakers are very difficult to shape in order for them to match the shape of a typical ear canal. Thus, the form factor of conventional miniature speakers is surely not flexible.

It may be seen as an object of embodiments of the present invention to provide a miniature speaker having a flexible form factor and an increased SPL without increasing the overall volume of the miniature speaker.

It may be seen as a further object of embodiments of the present invention to provide a miniature speaker having a flexible form factor and being capable of delivering an SPL larger than 95 dB although its overall volume is around 40 $mm^3$.

DESCRIPTION OF THE INVENTION

The above-mentioned objects are complied with by providing, in a first aspect, a miniature speaker comprising a plurality of sound generating elements, wherein each sound generating element comprises a sound cavity and a moveable element associated therewith, wherein the moveable element comprises one or more cantilever beams configured to move said moveable element and thus generate sound pressure waves in response to an applied drive signal.

In the present context, and as it will be discussed in further details below, the term "miniature speaker" should be understood as a speaker having an overall volume below 500 $mm^3$, such as below 400 $mm^3$, such as below 300 $mm^3$, such as below 200 $mm^3$, such as below 100 $mm^3$, such as below 50 $mm^3$, such as around 40 $mm^3$. In order to fit into a receiver assembly adapted to be positioned in the ear canal of a human being the typical dimensions of a miniature speaker according to the present invention may be 7 mm×3.3 mm×2 mm (L×W×H). The miniature speaker of the present invention is moreover advantageous in that it may be capable of delivering a SPL larger than 90 dB, such as larger than 95 dB, although its overall volume is around 40 $mm^3$.

The miniature speaker according to the present invention is moreover advantage in that it has a highly flexible form factor in that the plurality of sound generating elements may be arranged in almost any pattern, including one or more rows and other arrangements. The highly flexible form factor makes it easy to fit the shape of the miniature speaker into the ear canal in relation to for example receiver-in-canal (RIC) and in-the-ear (ITE) type hearing devices. A particular arrangement of the plurality of sound generating elements may also serve other purposes than matching the shape of a certain ear canal in that optimization of acoustical performance, high efficiency as well as low power consumption may also be dealt with.

Each of the one or more cantilever beams may comprise a piezoelectric layer sandwiched between two electrodes configured to receive the applied drive signal. The piezoelectric layer will either stretch or compress when an electrical drive signal is applied to the two electrodes, i.e. across the piezoelectric layer. The one or more cantilever beams will bend or deflect in response to the stretching or compression of the piezoelectric layer. The one or more cantilever beams may further comprise a carrier element adapted to support one or more piezoelectric layers and electrodes associated therewith.

The one or more cantilever beams of each sound generating element may form one or more arrays of cantilever beams. In case a plurality of arrays of cantilever beams are associated with a single sound generating element these arrays of cantilever beams may be essentially identical or they may be different in terms of for example the number, the shape, the orientation and/or the dimensions of the cantilever beams. Moreover, at least two sound cavities among the plurality of sound cavities may be different volumes. Even further, at least two sound cavities among the plurality of sound cavities may be acoustically connected. This acoustical connection may be provided by an opening in a MEMS die or between a MEMS die and a carrier substrate as discussed in further details below.

In order to support the highly flexible form factor of the miniature speaker a first group of sound generating elements may form part of a first MEMS die. The first group may comprise one or more sound generating elements. The first MEMS die may be arranged on a surface of a first carrier substrate having a plurality of through-going openings arranged therein, and the plurality of through-going openings may be acoustically connected to the first group of sound generating elements. In fact the plurality of through-going openings may in particular be acoustically connected to the sound cavities of first group of sound generating elements. The first carrier substrate may comprise a printed circuit board or a flex print, the printed circuit board or the flex print comprising electrical conducting paths configured to lead a drive signal to the first group of sound generating elements via the first carrier substrate. This is advantageous in that free hanging electrical wires may then be omitted.

In one embodiment of the invention the plurality of through-going openings in the first carrier substrate may acoustically connect the first group of sound generating elements to one or more front volumes. In a particular embodiment the plurality of through-going openings in the first carrier substrate may acoustically connect the first group of sound generating elements to a common front volume, said common front volume being acoustically connected to a sound outlet in a housing of the miniature speaker.

In another embodiment the plurality of through-going openings in the first carrier substrate may acoustically connect the first group of sound generating elements to one or more rear volumes. One or more venting openings may in general be provided between one or more rear volumes and an exterior volume of the miniature speaker.

The highly flexible form factor of the miniature speaker may be further supported in that a second group of sound generating elements may form part of a second MEMS die arranged on a second carrier substrate having a plurality of through-going openings arranged therein, wherein the plurality of through-going openings are acoustically connected to the second group of sound generating elements, and wherein the second carrier substrate may comprise a printed circuit board or a flex print comprising electrical conducting paths configured to lead a drive signal to the second group of sound generating elements via the second carrier substrate, and wherein the plurality of through-going openings in the first and second carrier substrates are acoustically connected to a common front volume arranged between the first and second carrier substrates, said common front volume being acoustically connected to a sound outlet in a housing of the miniature speaker. The first and second carrier substrates may be arranged in an essential parallel manner so the common front volume may be provided between the first and second carrier substrates.

In a second aspect the present invention relates to a receiver assembly for a hearing device, the receiver assembly comprising a miniature speaker according to the first aspect.

In a third aspect the present invention relates to a hearing device, such as a receiver-in-canal hearing device, comprising a receiver assembly according to the second aspect.

In general the various aspects of the invention may be combined and coupled in any way possible within the scope of the invention. These and other aspects, features and/or advantages of the invention will be apparent from and elucidated with reference to the embodiments described hereinafter.

BRIEF DESCRIPTION OF THE DRAWINGS

The present invention will now be explained in further details with reference to the accompanying figures, wherein.

Figure 1:
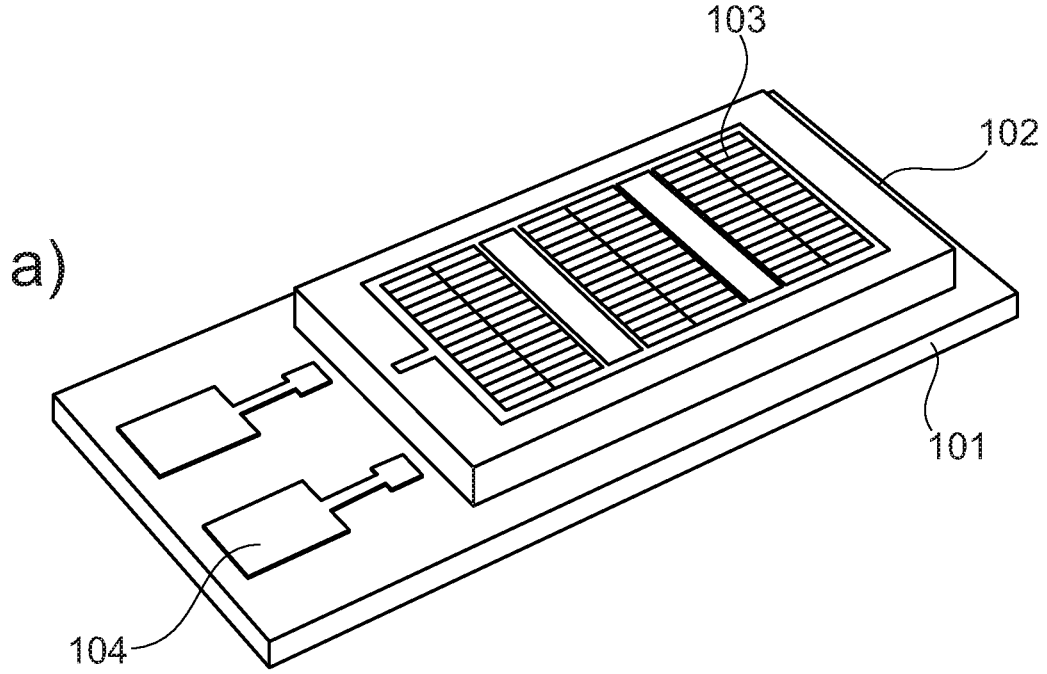
FIG. 1 shows a single miniature speaker implementation.
Figure 1:
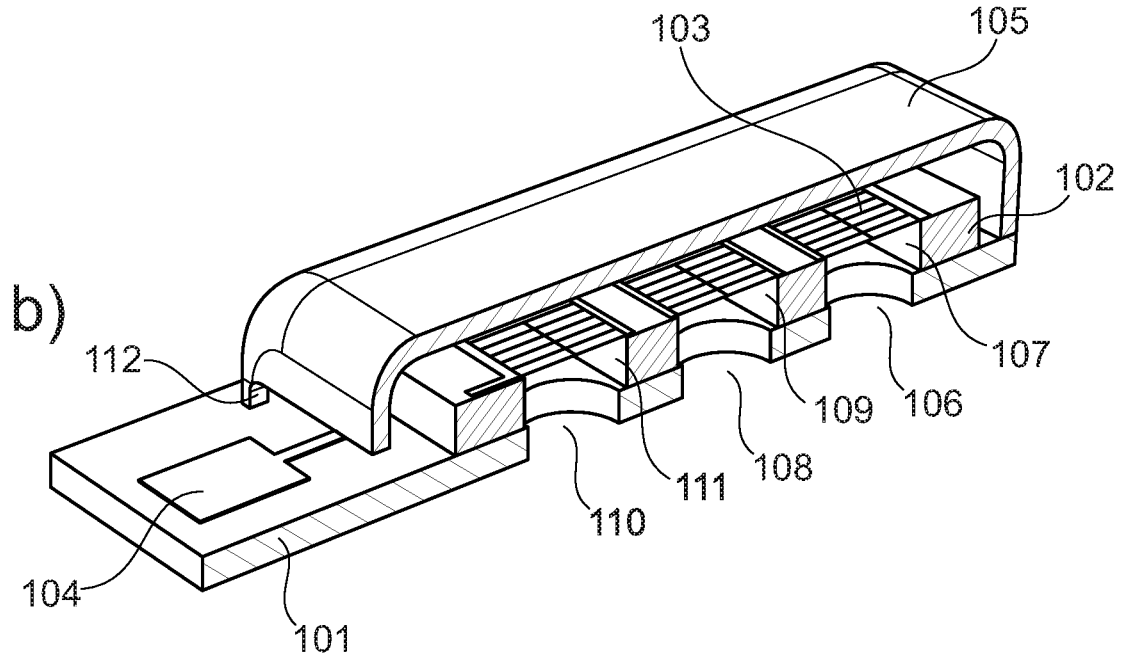

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In a general aspect the present invention relates to a miniature speaker comprising multiple sound cavities each having one or more cantilever beams associated therewith. The one or more cantilever beams of each cavity form a moveable element in the form of a moveable diaphragm being capable for generating sound pressure waves in response to applying a drive signal to the one or more cantilever beams. The one or more cantilever beams may be arranged in various manners, such as a single row of cantilever beams or two opposing rows of cantilever beams. Each of the one or more cantilever beams may comprise an integrated drive mechanism, such as a piezoelectric material sandwiched between two electrodes to which electrodes the drive signal is applied. Upon applying a drive signal to the two electrodes the piezoelectric material will stretch or compress causing the one or more cantilever beams to bend or deflect. The typical drive signal has an RMS value of around 3 V, but it may, under certain circumstances, be as high as 50 V.

The overall volume of the miniature speaker is below 500 $mm^3$, such as below 400 $mm^3$, such as below 300 $mm^3$, such as below 200 $mm^3$, such as below 100 $mm^3$, such as below 50 $mm^3$, such as around 40 $mm^3$. The typical dimensions of a miniature speaker are 7 mm×3.3 mm×2 mm (L×W×H). The miniature speaker of the present invention is advantageous in that it is capable of delivering a SPL larger than 90 dB, such as larger than 95 dB, although its overall volume is around 40 $mm^3$.

Referring now to FIG. 1*a* a three-dimensional view of a miniature speaker according to an embodiment of the present invention is depicted. In FIG. 1*a* a MEMS die 102 is arranged on a PCB 101 having contact pads 104 arranged thereon. The MEMS die 102 is secured to the PCB 101 using an appropriate technique. The contact pads 104 are electrically connected to the three arrays of cantilever beams 103 arranged on or integrated with the MEMS die 102. With this arrangement a drive signal for driving the cantilever beams 103 may be provided via the contact pads 104. As it will be discussed in further details below each of the three arrays of cantilever beams 103 functions as a moveable diaphragm when an electrical drive signal is applied thereto.

Turning now to FIG. 1*b* a cross-sectional view of the miniature speaker in FIG. 1*a* is depicted. Again, the MEMS die 102, the PCB 101, the arrays of cantilever beams 103 and the contact pads 104 are visible. Below each of the arrays of cantilever beams 103 associated sound cavities 107, 109, 111 are provided. Each of these sound cavities 107, 109, 111 are acoustically connected to respective through-going openings 106, 108, 110 in the PCB 101. As it will be discussed in further details below these through-going openings 106, 108, 110 may be acoustically connected to front and/or rear volumes (not shown) of the miniature speaker. FIG. 1*b* further depicts part of a speaker housing 105 under which speaker housing 105 a front or a rear volume may be formed. The speaker housing 105 is secured to the PCB 101 using an appropriate technique. In order to prevent short circuiting of the contact pads 104 an opening 112 may be provided between the PCB 101 and the speaker housing 105. It should be noted that the number of sound cavities 107, 109, 111 in the MEMS die 102 and the number of associated through-going openings 106, 108, 110 in the PCB 101 may differ from the three depicted in FIG. 1*b*. Moreover, the sound cavities 107, 109, 111 may differ in size, shape as well as orientation.

Figure 2:
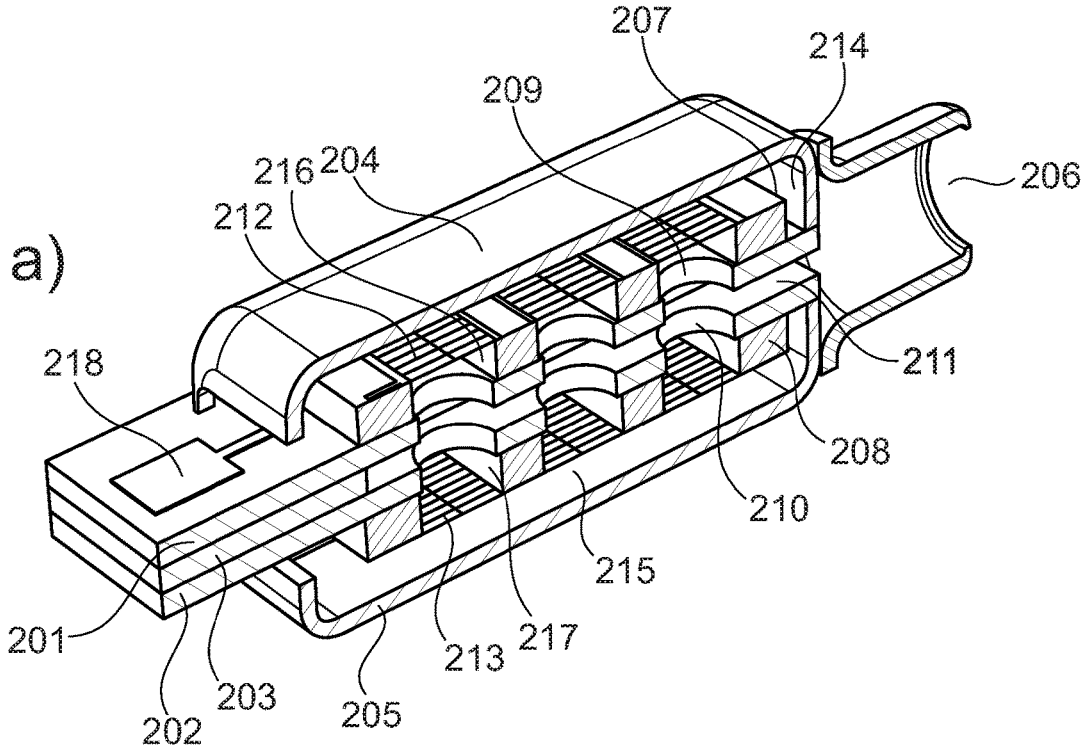
FIG. 2 shows a dual miniature speaker implementation.
Figure 2:
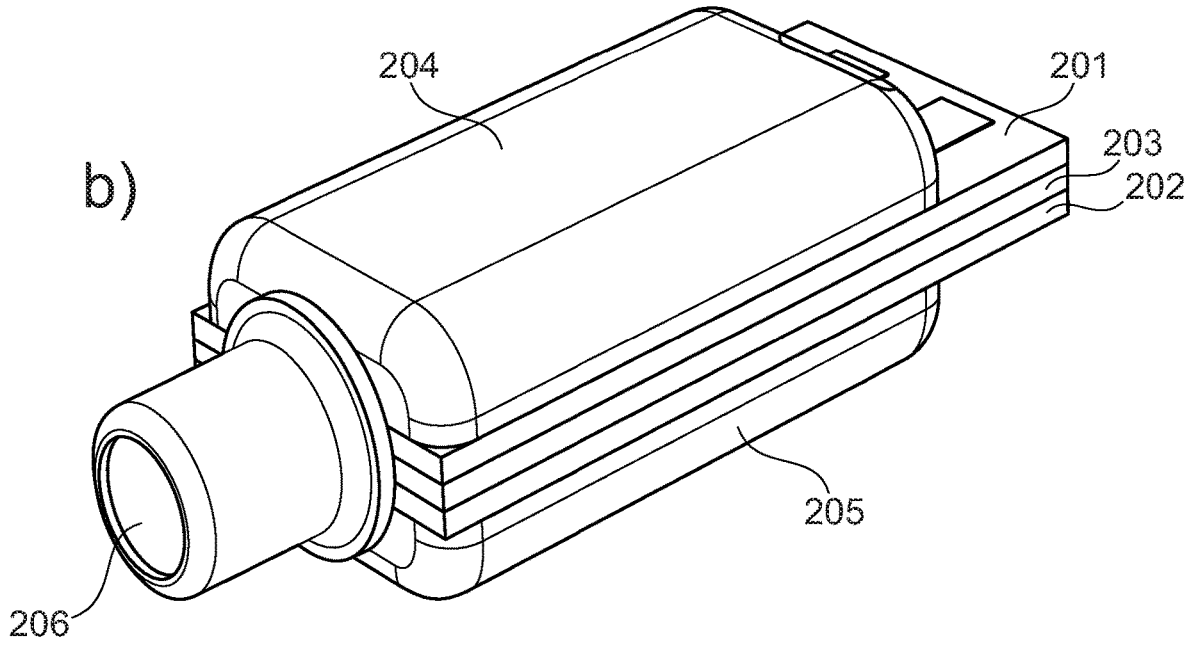

Turning now to FIG. 2*a* a cross-sectional view of a dual miniature speaker is depicted. The dual miniature speaker comprises two PCBs 201, 202 between which a front volume 211 is formed. The front volume 211 is acoustically connected to a spout having a sound outlet 206. The two PCBs 201, 202 are spaced apart by a spacer 203 sandwiched between end portions of the two PCBs 201, 202. As depicted in FIG. 2*a* the dual miniature speaker comprises an upper MEMS die 207 secured to the upper PCB 201. The upper MEMS die 207 comprises three sound cavities 216 and three associated arrays of cantilever beams 212 arranged on or integrated with the upper MEMS die 207. A drive signal to the three arrays of cantilever beams 212 may be provided via contact pads 218 (only one contact pad is visible). As it will be discussed in further details below each of the three arrays of cantilever beams 212 functions as a moveable diaphragm when a drive signal is applied thereto. The three sound cavities 216 of the upper MEMS die 207 are acoustically connected to the front volume 211 via respective through-going openings 209 in the upper PCB 201. Similarly, the lower MEMS die 208 comprises three sound cavities 217 and three associated arrays of cantilever beams 213 arranged on or integrated with the lower MEMS die 208. A drive signal to the three arrays of cantilever beams 213 may be provided via contact pads (not shown) on the lower PCB 202. Each of the three arrays of cantilever beams 213 functions as a moveable diaphragm when a drive signal is applied thereto, and the three sound cavities 217 of the lower MEMS die 208 are acoustically connected to the front volume 211 via respective through-going openings 210 in the lower PCB 202. Thus, the front volume 211 acts as a common front volume which, as previously addressed, is acoustically connected to the sound outlet 206 of the spout of the dual miniature speaker. As depicted in FIG. 2*a* respective rear volumes 214, 215 are formed between the PCBs 201, 202 and speaker housings 204, 205. It should be noted that the number of sound cavities in the MEMS dies and the number of associated through-going openings in the PCBs may differ from the three depicted in FIG. 2*a*. Moreover, the sound cavities may differ in size, shape as well as orientation.

FIG. 2*b* shows a three-dimensional view of an assembled dual miniature speaker comprising speaker housings 204, 205 secured to respective PCBs 201, 202 which are spaced apart by a spacer 203. Generated sound pressure waves leave the dual miniature speaker via the sound outlet 206 in the spout.

Figure 3:
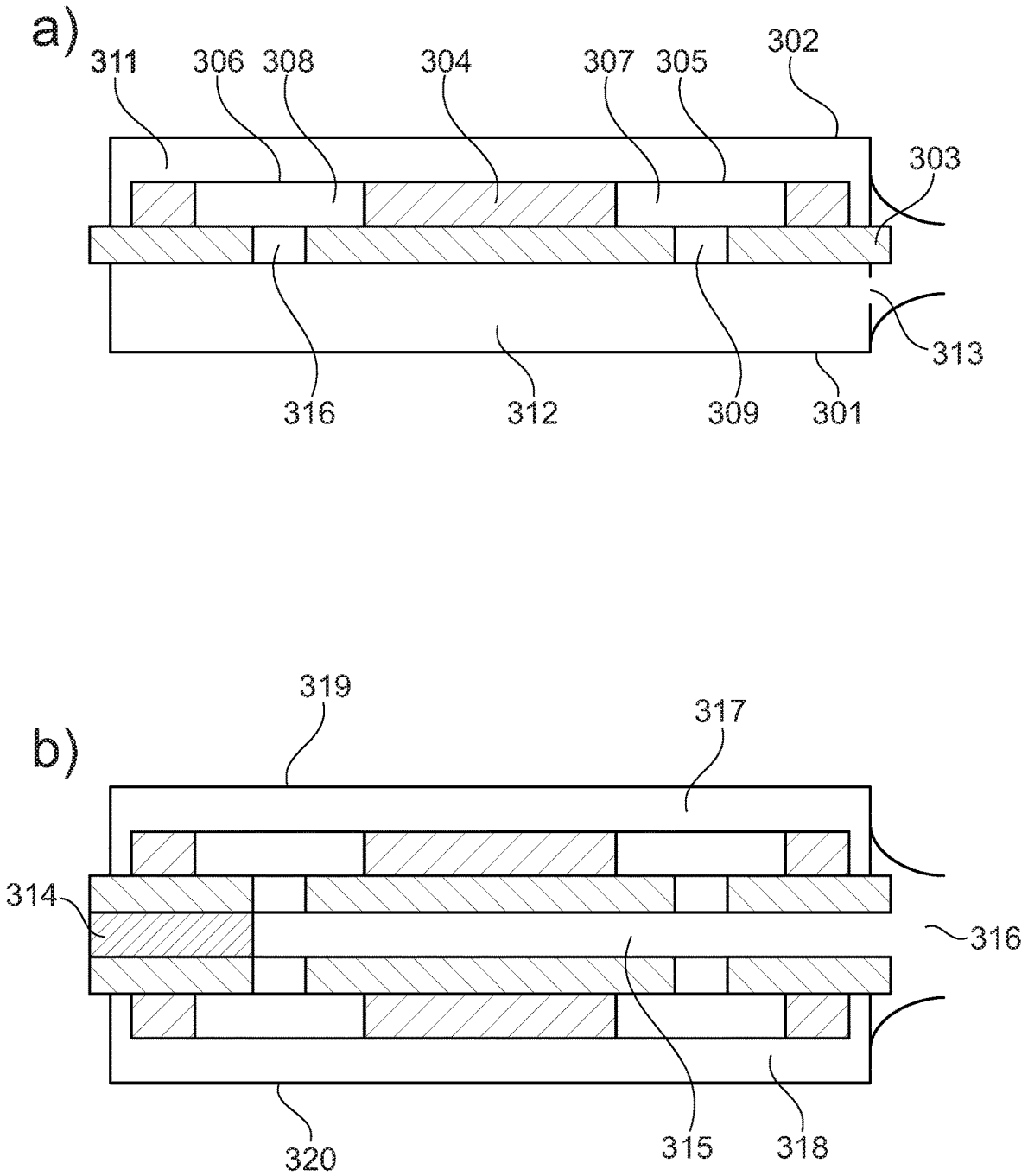
FIG. 3 shows cross-sectional views of a single and a dual miniature speaker implementations.

In FIG. 3 simplified schematics of both a single and a dual miniature speaker are depicted in cross-sectional views. With reference to FIG. 3*a* the single miniature speaker comprises a MEMS die 304 arranged on a PCB 303, wherein the MEMS die 304 comprises sound cavities 307, 308 with respective arrays of cantilever beams 305, 306 associated therewith. The associated arrays of cantilever beams 305, 306, which may be arranged on or integrated with the MEMS die 304, are configured to generate sound pressure waves in response to a drive signal applied thereto. The arrays of cantilever beams 305, 306 function as moveable diaphragms in response to the drive signal applied thereto. As depicted in FIG. 3*a* the sound cavities 307, 308 are acoustically connected to the front volume 312 via respective through-going openings 309, 310 in the PCB 303. The front volume 312 is acoustically connected to the sound outlet 313 in the speaker housing 301 and the sound outlet in the spout. A rear volume 311 is formed between the PCB 303 and the speaker housing 302. As previously mentioned the number of sound cavities 307, 308 in the MEMS die 304 and the number of associated through-going openings 309, 310 in the PCB 303 may differ from the two depicted in FIG. 3*a*. Moreover, the sound cavities 307, 308 may differ in size, shape as well as orientation.

FIG. 3*b* shows a dual miniature speaker comprising essentially two single miniature speakers of the type shown in FIG. 3*a*. As depicted in FIG. 3*b* a spacer 314 is arranged between end portions of the two PCBs whereby a front volume 315 is formed between the two PCBs. The front volume 315 is acoustically connected to the sound outlet 316 in the spout. A pair of rear volumes 317, 318 are provided inside respective speaker housings 319, 320.

Figure 4:
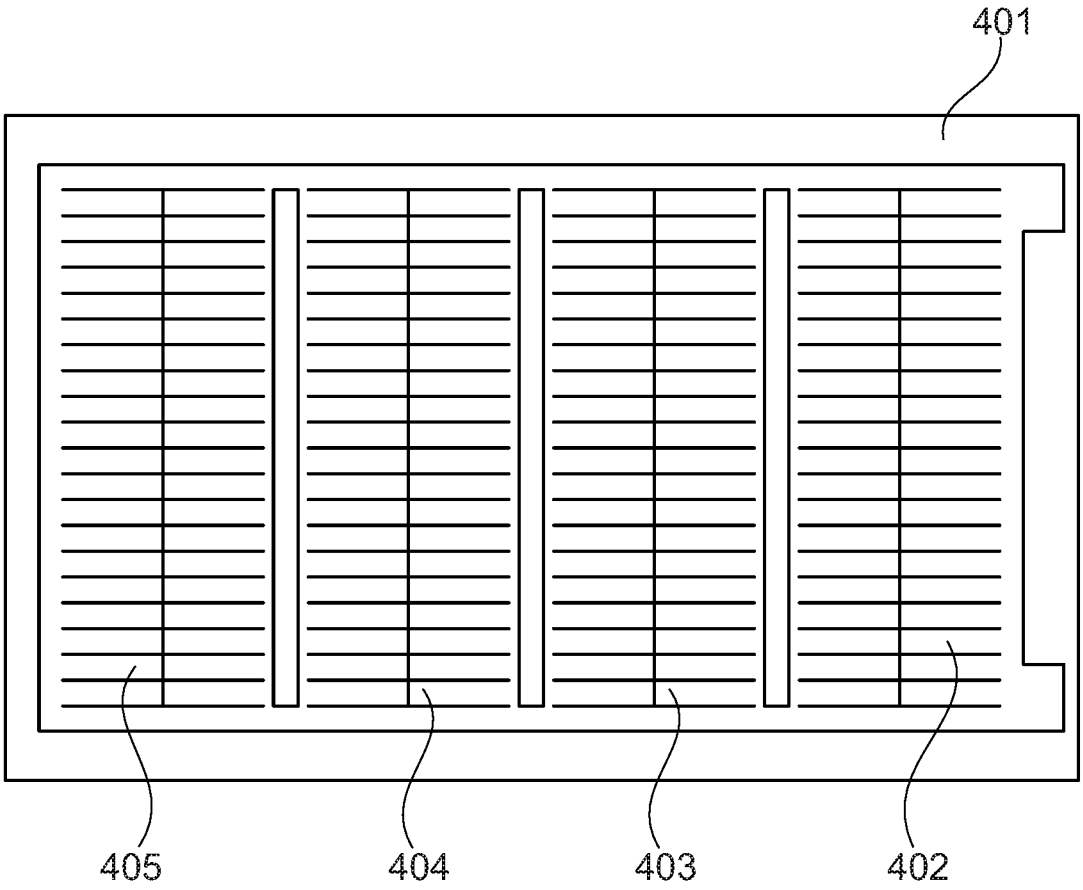
FIG. 4 shows four arrays of identical cantilever beams.

Turning now to FIG. 4 four arrays of cantilever beams 402-405 are arranged on a frame structure 401. Each of the cantilever arrays 402-405 comprises two opposing rows of cantilever beams. As seen in FIG. 4 each row of cantilever beams comprises 20 identical cantilever beams. It should however be noted that the dimensions of the cantilever beams may be different as discussed in further details in connection with FIG. 6. Thus, although the typical dimensions of the cantilever beams are 400 μm×100 μm×3 μm (L×W×H) the length, width and height of the cantilever beams may be between 200-1000 μm, 25-1000 μm and 1-40 μm, respectively. Even within the same cantilever array the cantilever beams may have different dimensions.

Figure 5:
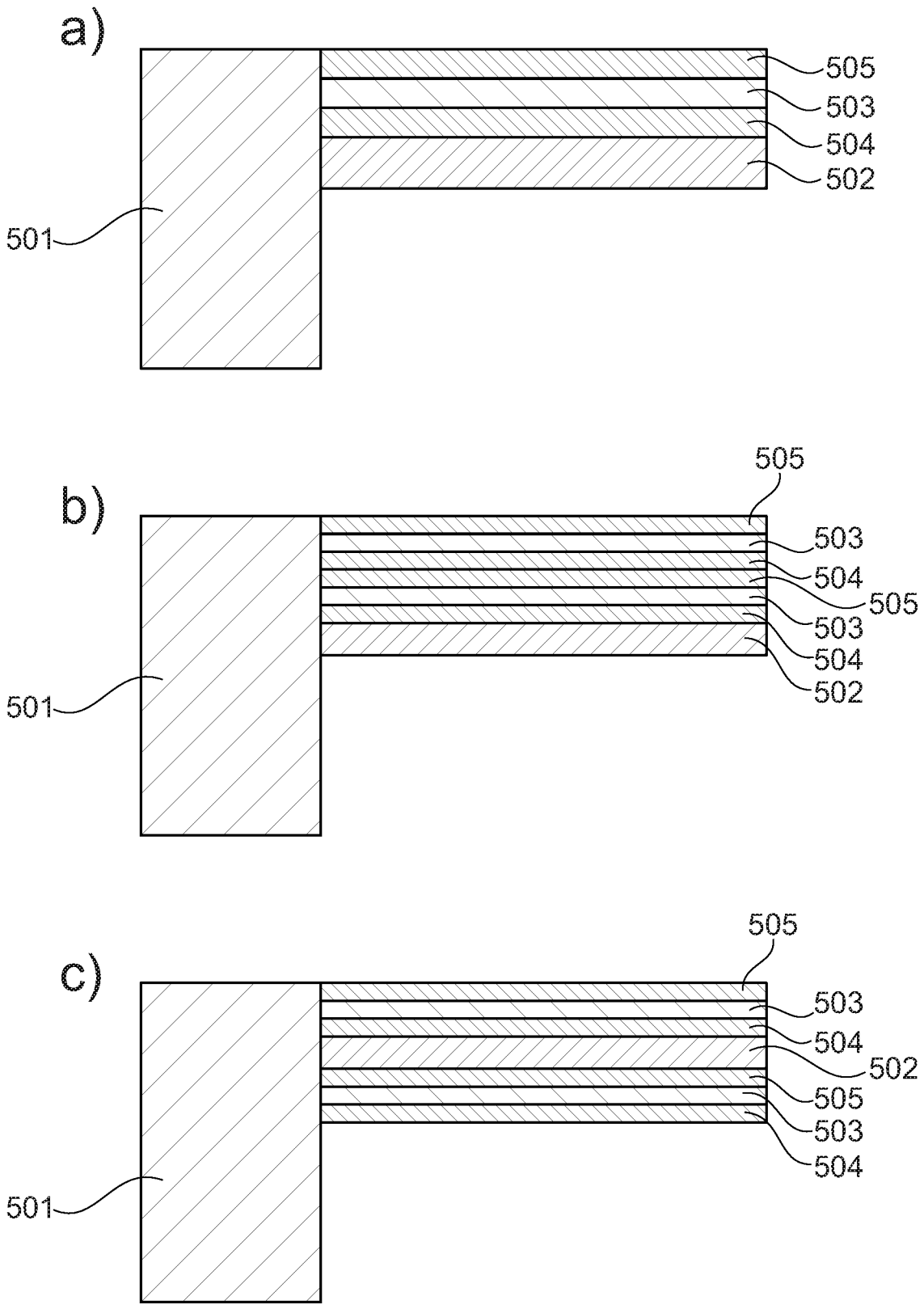
FIG. 5 shows three possible implementations of piezoelectric cantilever beams.

As previously disclosed an arrays of cantilever beams, i.e. for example two opposing rows of cantilever beams, may, in combination, function as a moveable diaphragm when a drive signal is applied to the cantilever beams. In order to facilitate this function an integrated drive mechanism is integrated within each of the cantilever beams in order to bend or deflect the cantilever beams in response to an applied drive signal. This integrated drive mechanism may, as depicted in FIG. 5, be implemented using a piezoelectric material sandwiched between two electrodes. Upon applying a drive signal to the two electrodes an electric field is generated across the piezoelectric material which causes the piezoelectric material to stretch or compress. As a result the one or more cantilever beams will bend or deflect.

As shown in FIG. 5*a* the piezoelectric material 503 is sandwiched between the two electrodes 504, 505 where the lowest electrode 504 is arranged on a carrier substrate 502. The piezoelectric material 503, the two electrodes 504, 505 and the carrier substrate 502 are secured to the MEMS die 501. In FIG. 5*b* the two piezoelectric materials 503 are sandwiched between respective pairs of electrodes 504, 505 where again the lowest electrode 504 is arranged on a carrier substrate 502. The two electrodes 504, 505 may be electrically isolated from each other so that the upper and lower piezoelectric materials 503 may be activated independently. The two piezoelectric materials 503, the four electrodes 504, 505 and the carrier substrate 502 are secured to the MEMS die 501. In FIG. 5*c* the two piezoelectric materials 503 are again sandwiched between respective pairs of electrodes 504, 505. Contrary to the arrangement depicted in FIG. 5*b* the upper piezoelectric material 503 with associated electrodes 504, 505 are arranged on top of the carrier substrate 502, whereas the lower piezoelectric material 503 with associated electrodes 504, 505 are arranged below the carrier substrate 502. Again, the two piezoelectric materials 503, the four electrodes 504, 505 and the carrier substrate 502 are secured to the MEMS die 501. It should in general be noted that two piezoelectric materials may be different in for example length and width. The electrodes may also be different from each other. It should in general be noted that the piezoelectric material 503 and/or the carrier substrate 502 may form an integral part of the MEMS die 501 instead of being secured thereto.

In FIGS. 5*b* and 5*c* two separate drive mechanisms each comprising a piezoelectric material 503 sandwiched between associated electrodes 504, 505 are depicted. These drive mechanisms may be operated by applying a common drive signal thereto, or they may be operated independently by applying separate drive signals to the two drive mechanisms.

Figure 6:
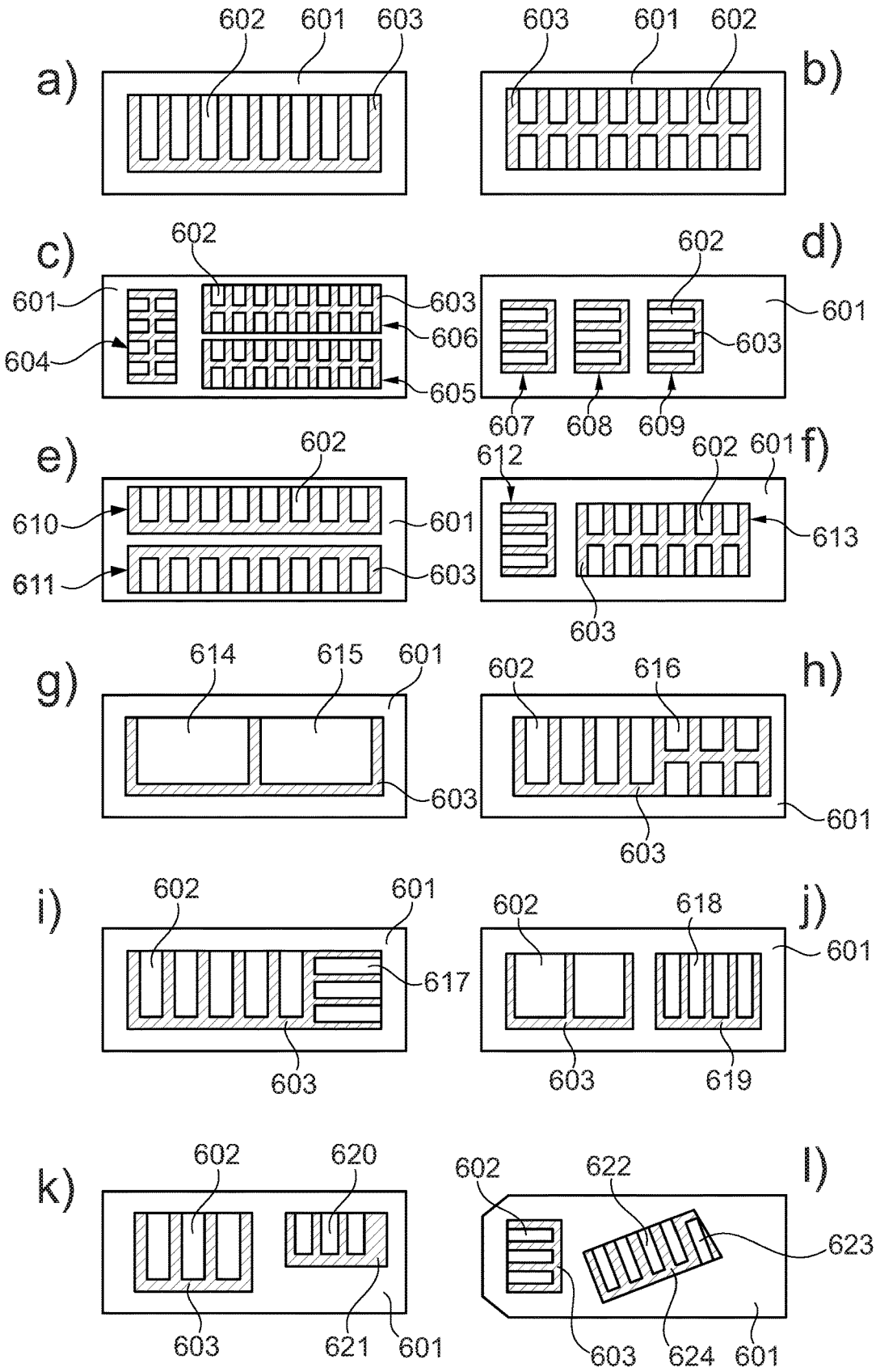
FIG. 6 shows various configurations of arrays of cantilever beams.

In FIG. 6 various arrangements and geometries of the cantilever beams are depicted. Starting at FIG. 6*a* a one-dimensional array (single row) of essentially identical cantilever beams 602 surrounded by air gaps 603 is depicted. The cantilever beams 602 are secured to the MEMS die 601 using appropriate fastening techniques. The MEMS die 601 is secured to a substrate (not shown), such as a PCB. In FIG. 6*b* two rows of essentially identical cantilever beams 602 surrounded by air gaps 603 are depicted. Again, the cantilever beams 602 are secured to the MEMS die 601 by appropriate means. In FIG. 6*c* three arrays 604, 605, 606 of cantilever beams 602 are depicted. Each cantilever array 604, 605, 606 comprises two opposing rows of essentially identical cantilever beams 602 surrounded by air gaps 603. As seen in FIG. 6*c* the arrays 605, 606 are essentially identical, whereas array 604 comprises fewer cantilever beams. Again, the arrays 604, 605, 606 of cantilever beams are secured to the MEMS die 601. FIG. 6*d* shows three one-dimensional arrays 607, 608, 609 of cantilever beams. Each array of cantilever beams thus comprises a single row of essentially identical cantilever beams 602 surrounded by air gaps 603. The arrays 607, 608, 609 of cantilever beams are oriented and secured to the MEMS die 601 in a similar manner. FIG. 6*e* shows two one-dimensional arrays 610, 611 of cantilever beams. Each array of cantilever beams comprises a single row of essentially identical cantilever beams 602 surrounded by air gaps 603. The arrays 610, 611 of cantilever beams are mutually arranged in an opposing manner and secured to the MEMS die 601. FIG. 6*f* shows a one-dimensional array 612 and a two-dimensional array 613 of cantilever beams. The one-dimensional array 612 comprises a single row of essentially identical cantilever beams, whereas the two-dimensional array 613 comprises two opposing rows of essentially identical cantilever beams. The cantilever beams 602 are surrounded by air gaps 603, and they are secured to the MEMS die 601. As seen in FIG. 6*f* the one-dimensional array 612 and the two-dimensional array 613 of cantilever beams are arranged essentially perpendicular to each other. In FIG. 6*g* two wide cantilever beams 614, 615 are surrounded by air gaps 603. The two cantilever beams 614, 615 are secured to the MEMS die 601. The width of the two cantilever beams 614, 615 are different. It should however be noted that the width may also be essentially the same. FIG. 6*h* shows both a single row of cantilever beams 602 and two opposing rows of essentially identical cantilever beams 616 surrounded by air gaps 603. The cantilever beams 602 of the single row are longer than the cantilever beams 616 of the opposing rows. Again, the cantilever beams are secured to the MEMS die 601. FIG. 6*i* shows two single rows of cantilever beams 602, 617 with different orientations in that cantilever beams 602 are arranged essentially perpendicular to cantilever beams 617. The cantilever beams 602, 6017 are surrounded by air gaps 603, and they are secured to the MEMS die 601. FIG. 6*j* shows separated groups of cantilever beams 602, 6018 surrounded by respective air gaps 603, 619 where each group has a single row of essentially identical cantilever beams 602, 618. However, the width of the cantilever beams 602 is significantly wider than the width of the cantilever beams 618. The cantilever beams 602, 618 are secured to the MEMS die 601. FIG. 6*k* also shows separated groups of cantilever beams 602, 620 where each group has a single row of essentially identical cantilever beams 602, 620. However, the length of the cantilever beams 602 are longer than the length of the cantilever beams 620. The cantilever beams 602, 620, which are surrounded by air gaps 603, 621, are secured to the MEMS die 601. Finally, FIG. 6*l* shows separated groups of cantilever beams 602, 622, 623 having different shapes and orientations. A single row of essentially identical cantilever beams 602 is surrounded by air gaps 603, whereas a single row of essentially identical cantilever beams 622 plus an additional cantilever beam 623 are surrounded by air gaps 624. Again, the cantilever beams 602, 622, 623 are secured to the MEMS die 601. In view of the various illustrations depicted in FIG. 6 it is clear that arrays of cantilever beams may be implemented as well as oriented in a variety of ways. Moreover, the layout of cantilever beams may be implemented in various ways in terms of length, width and thickness.

It should in general be noted that the various air gaps addressed in connection with FIG. 6, i.e. air gaps between cantilever beams as well as air gaps between cantilever beams and MEMS die/casing may be left open, or they may be completely sealed or at partly sealed. In FIG. 6 the various air gaps are depicted as open air gaps.

Figure 7:
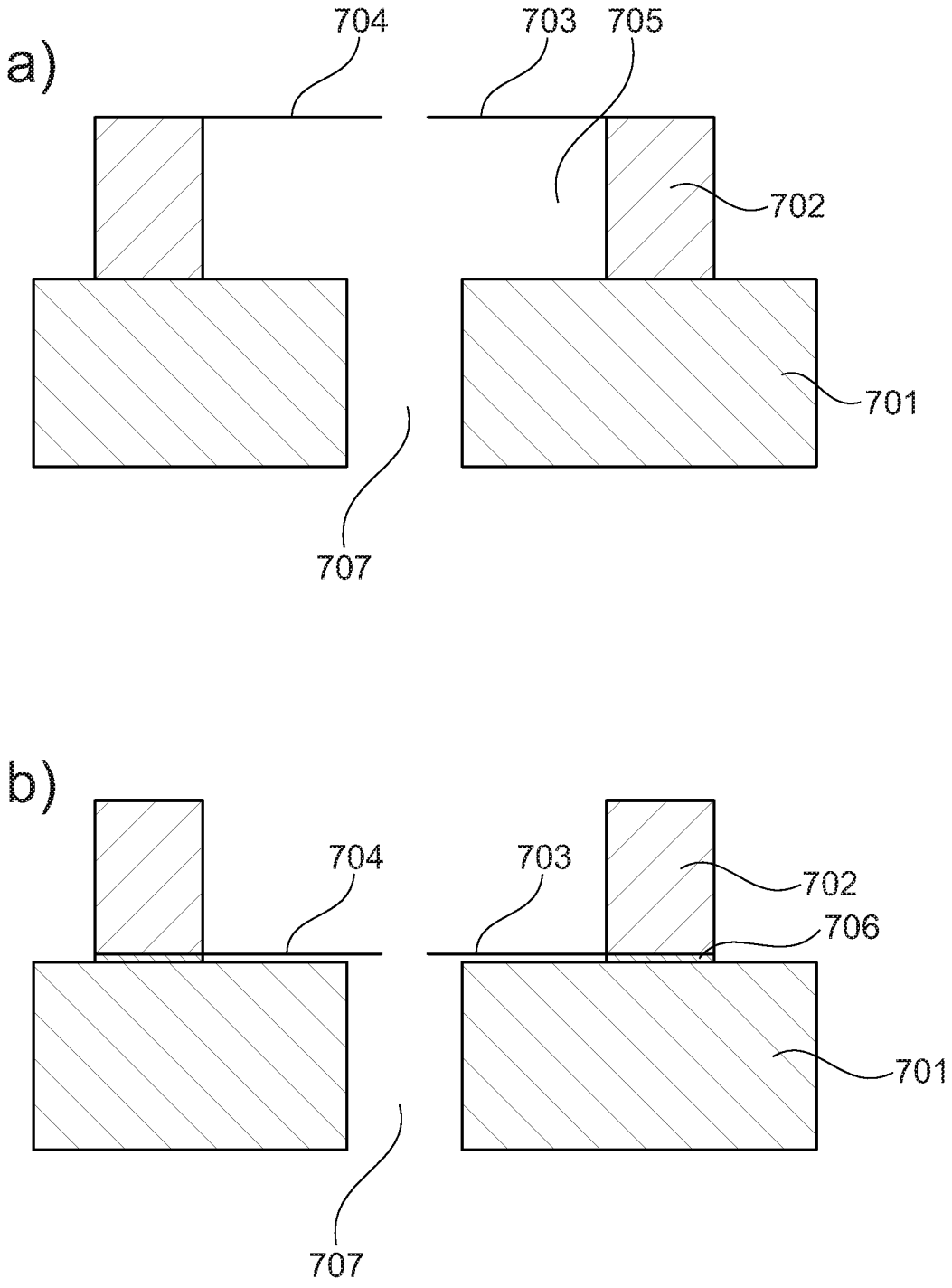
FIG. 7 shows a normal mounted MEMS die on a substrate and a flip-chip mounted MEMS die on a substrate.

FIG. 7 shows two possible ways of mounting MEMS dies 702 on substrates 701 which may be PCBs, flex prints, metal substrates, polymer substrates etc. In FIG. 7*a* the MEMS die 702 is mounted on the substrate 701 with the cantilever beams 703, 704, or rows of cantilever beams, facing away from the substrate 701. The MEMS die 702 is secured to the substrate 701 using appropriate securing techniques. In the implementation shown in FIG. 7*a* a sound cavity 705 is formed in the MEMS die 702 below the cantilever beams 703, 704, or rows of cantilever beams. The sound cavity 705 is acoustically connected to the through-going opening 707 in the substrate 701. In FIG. 7*b* the MEMS die 702 is mounted on the substrate 701 with the cantilever beams 703, 704, or rows of cantilever beams, facing towards the substrate 701, i.e. in an upside down geometry. Again, the MEMS die 702 is secured to the substrate 701 using appropriate flip-chip mounting techniques which may involve solder bumps 706. Contrary of the implementation depicted in FIG. 7*a* no sound cavity is formed in the MEMS die 702. Instead the through-going opening 707 in the substrate 701 may be considered a sound cavity being positioned below the cantilever beams 703, 704, or rows of cantilever beams.

Figure 8:
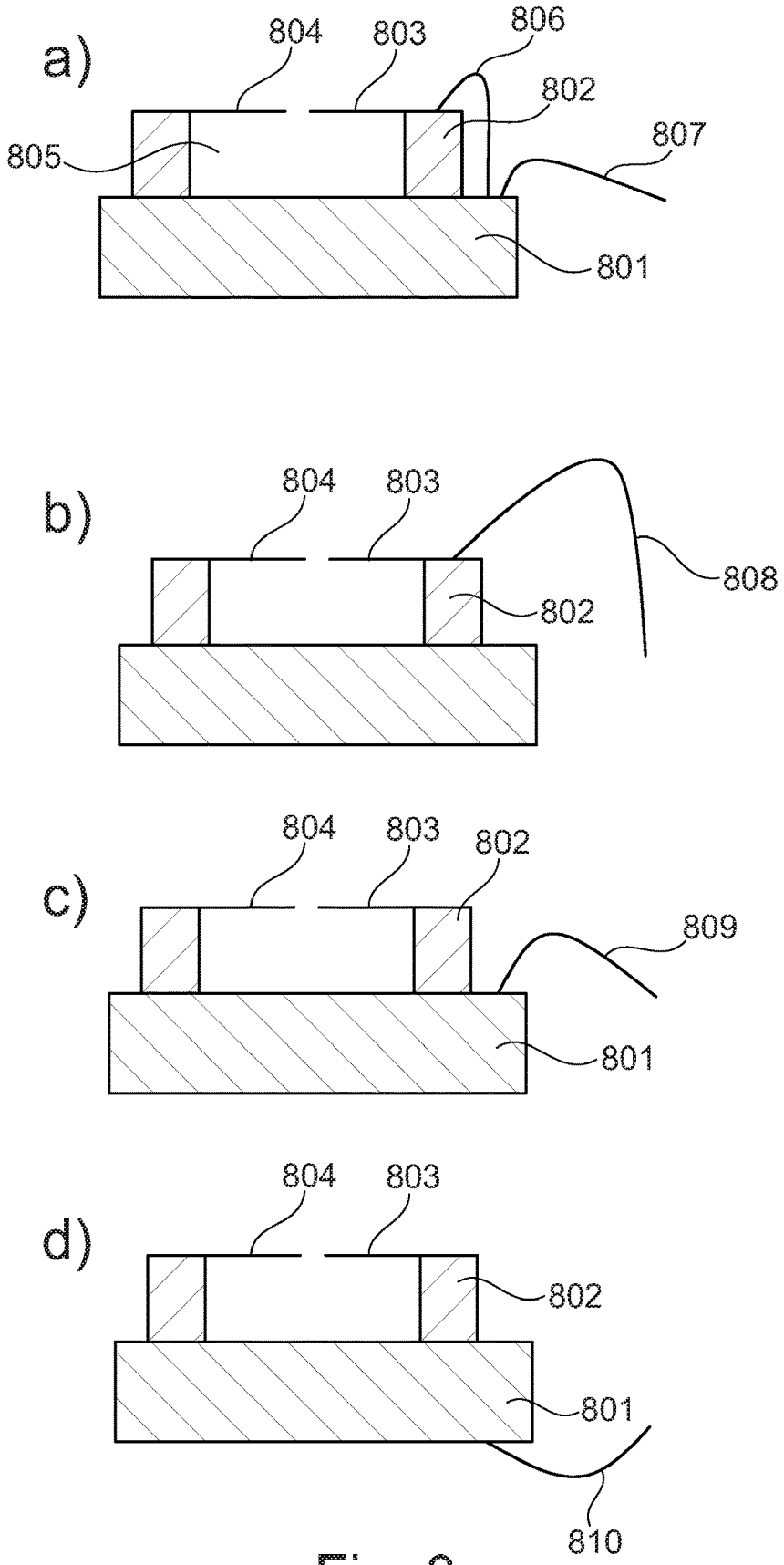
FIG. 8 shows various configurations of wiring of MEMS dies/cantilever beams.

As previously addressed the arrays of cantilever beams of the miniature speaker according to the present invention function as a moveable diaphragm. In order to achieve this function one or more electrical drive signals need to be applied to the cantilever beams in order to bend or deflect the cantilever beams. Various possible implementations for connecting the arrays of cantilever beams to the surroundings are discussed in the following with reference to FIG. 8.

Referring now to FIG. 8*a* a MEMS die 802 is mounted on the substrate 801 with the cantilever beams 803, 804, or rows of cantilever beams, facing away from the substrate 801, and a sound cavity 805 is formed below the cantilever beams 803, 804, or rows of cantilever beams. The substrate 801 is a PCB. In FIG. 8*a* the cantilever beams 803, 804, or rows of cantilever beams, are electrically connected to the PCB via a wire connection 806. The PCB is electrically connected to the surroundings via wire connection 807. In FIG. 8*b* the cantilever beams 803, 804, or rows of cantilever beams, are electrically connected directly to the surroundings via wire connection 808. In FIG. 8*c* the cantilever beams 803, 804, or rows of cantilever beams, are electrically connected to the PCB 801 via the MEMS die 802. The upper side of the PCB 801 is electrically connected to the surroundings via wire connection 809. Also in FIG. 8*d* the cantilever beams 803, 804, or rows of cantilever beams, are electrically connected to the PCB 801 via the MEMS die 802. Electrical paths are provided through the PCB 801 so that the lower side of the PCB 801 is electrically connected to the surroundings via wire connection 810.

Figure 9:
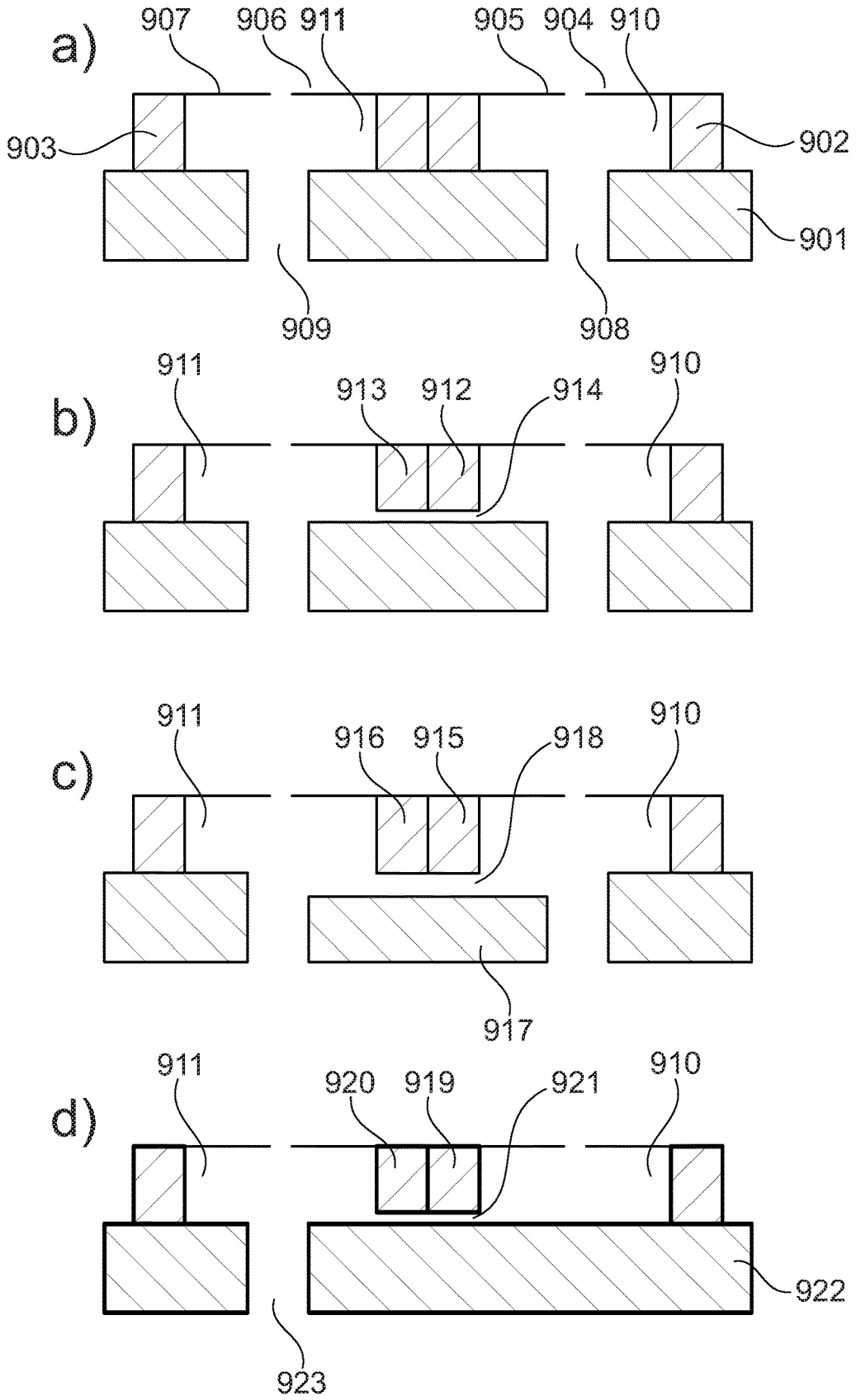
FIG. 9 shows implementations of various acoustical connections between sound cavities.

With reference to FIG. 9 various implementations of single miniature speakers with acoustical connections between sound cavities are depicted. Starting with FIG. 9*a* a single miniature speaker comprises two distinct MEMS dies 902, 903 arranged on a PCB 901 is depicted. The MEMS dies 902, 903 comprise respective sound cavities 910, 911 with respective cantilever beams 904, 905 and 906, 907, or rows of cantilever beams, associated therewith. The associated cantilever beams 904, 905 and 906, 907, or rows of cantilever beams, which may be arranged on or integrated with the respective MEMS dies 902, 903, are configured to generate sound pressure waves in response to drive signals applied thereto. The cantilever beams 904, 905 and 906, 907, or rows of cantilever beams, thus function as moveable diaphragms in response to drive signals applied thereto. As depicted in FIG. 9*a* the sound cavities 910, 911 are acoustically connected to respective through-going openings 908, 909 in the PCB 901. As previously mentioned the number of sound cavities 910, 911 in the respective MEMS dies 902, 903 and the number of associated through-going openings 908, 909 in the PCB 901 may differ from the two depicted in FIG. 9*a*. Moreover, the sound cavities 910, 911 may differ in size, shape as well as orientation.

Turning now to FIGS. 9*b-d* miniature speaker implementations with acoustical connections between the sound cavities 910, 911 are depicted. In FIG. 9*b* the height of the MEMS die portions 912, 913 are reduced thus leaving space for an acoustical connection 914 between the sound cavities 910, 911. Along the same route the height of the MEMS die portions 915, 916 and the height of the PCB portion 917 may be reduced thus leaving space for an even wider acoustical connection 918 between the sound cavities 910, 911, cf. FIG. 9*c*. Also in FIG. 9*d* the height of the MEMS die portions 919, 920 are reduced thus leaving space for an acoustical connection 921 between the sound cavities 910, 911. Moreover, the PCB 922 comprises only a single through-going opening 923 aligned with sound cavity 911.

Figure 10:
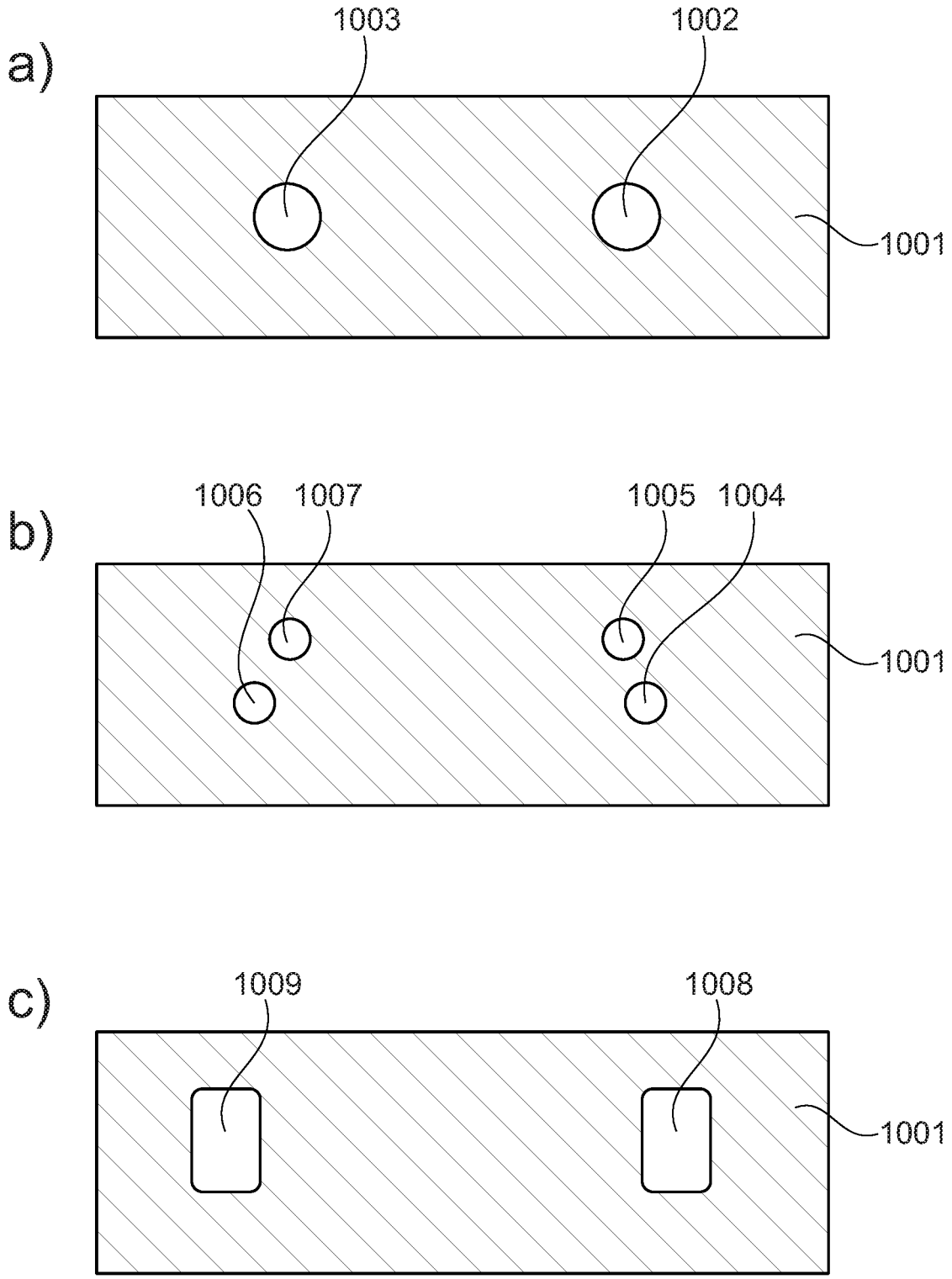
FIG. 10 shows implementations of various substrates.

FIG. 10 shows various implementations of the substrate 1001 to which the MEMS dies (not shown) are secured. As previously addressed the substrate 1001 may be a PCB, a flex print, a metal substrate, a polymer substrate etc. The substrates 1001 depicted in FIGS. 10*a-c* are configured to be secured to MEMS dies (not shown) having two sound cavities. In FIG. 10*a* the two sound cavities of the MEMS die are configured to be acoustically connected to respective through-going openings 1002, 1003 in the substrate 1001, whereas in FIG. 10*b* the two sound cavities of the MEMS die are configured to be acoustically connected to respective pairs of through-going openings 1004, 1005 and 1006, 1007 in the substrate 1001. Similarly, in FIG. 10*c* the two sound cavities of the MEMS die are configured to be acoustically connected to respective through-going rectangular openings 1008, 1009 in the substrate 1001.

Figure 11:
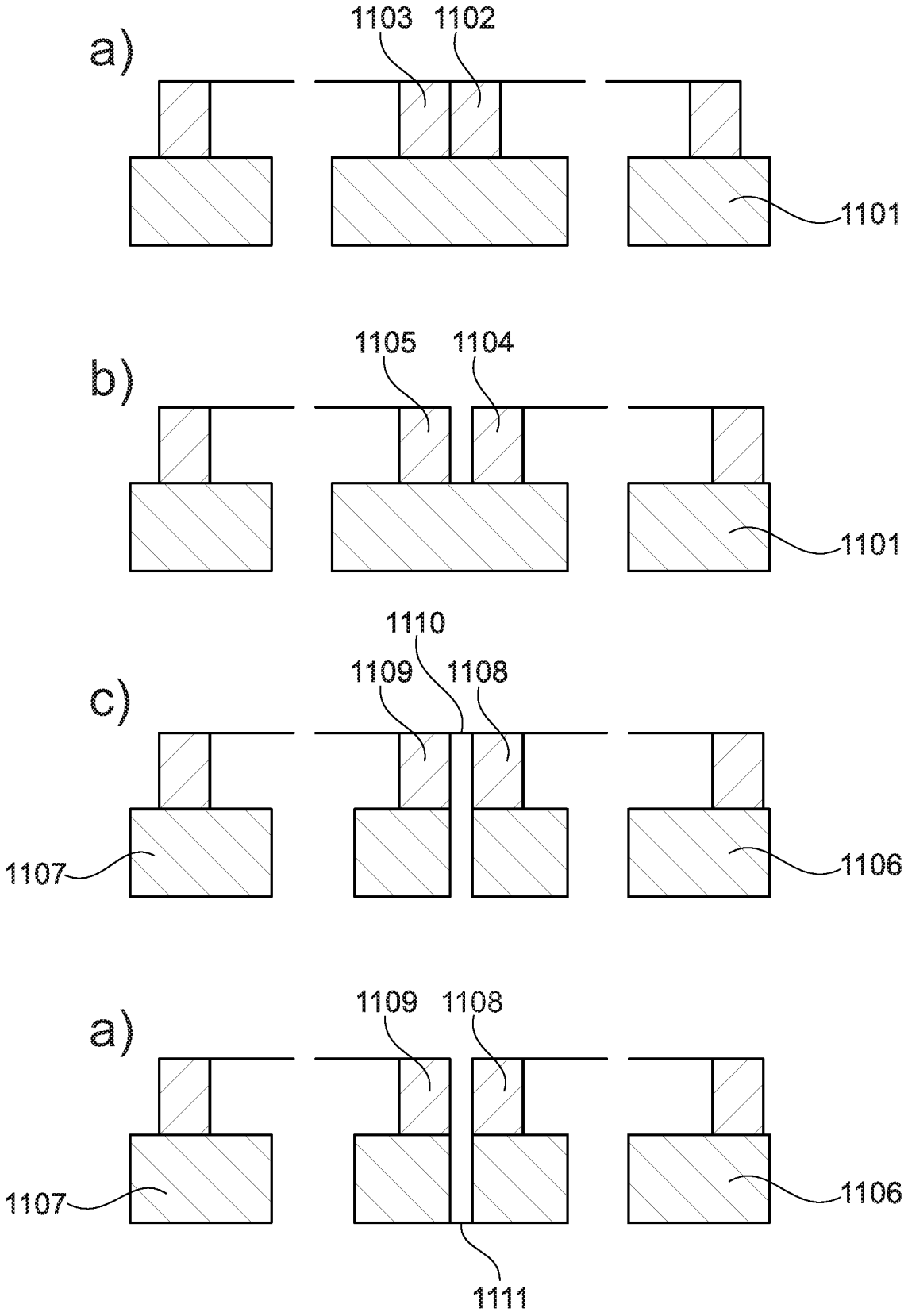
FIG. 11 shows implementations of multiple MEMS dies and/or multiple substrates.

Turning now to FIG. 11 various implementations of single miniature speakers involving separated MEMS dies and/or separated PCBs are depicted. In FIG. 11*a* a single miniature speaker comprises two distinct MEMS dies 1102, 1103 arranged on a common PCB 1101 is depicted. The MEMS dies 1102, 1103 comprise respective sound cavities with respective cantilever beams, or rows of cantilever beams, associated therewith. The associated cantilever beams, or rows of cantilever beams, which may be arranged on or integrated with the respective MEMS dies 1102, 1103, are configured to generate sound pressure waves in response to drive signals applied thereto. The cantilever beams, or rows of cantilever beams, thus function as moveable diaphragms in response to drive signals applied thereto.

As depicted in FIG. 11*a* the two MEMS dies 1102, 1103 are arranged next to each other leaving no free space therebetween, and the sound cavities of the MEMS dies 1102, 1103 are acoustically connected to respective through-going openings in the common PCB 1101. As previously mentioned the number of sound cavities in the respective MEMS dies 1102, 1103 and the number of associated through-going openings in the PCB 1101 may differ from the two depicted in FIG. 11*a*. Moreover, the sound cavities may differ in size, shape as well as orientation. Turning now to FIG. 11*b* the two MEMS dies 1104, 1105 are arranged on the common PCB 1101 with a distance therebetween, i.e. a distance between the two MEMS dies 1104, 1105. In FIG. 11*c* the two MEMS dies 1108, 1109 are arranged on respective PCBs 1106, 1107, and the two MEMS dies 1108, 1109 are electrically connected via a wire (not shown). An acoustical sealing 1110 is provided between the two MEMS dies 1108, 1109. As depicted in FIG. 11*c* free space is provided both between the two MEMS dies 1108, 1109 and the two PCBs 1106, 1107. Also in FIG. 11*d* the two MEMS dies 1108, 1109 are arranged on respective PCBs 1106, 1107, and the two PCBs 1106, 1107 are electrically connected via a wire (not shown). An acoustical sealing 1111 is provided between the two PCBa 1106, 1107. Again, free space is provided both between the two MEMS dies 1108, 1109 and the two PCBs 1106, 1107.

Figure 12:
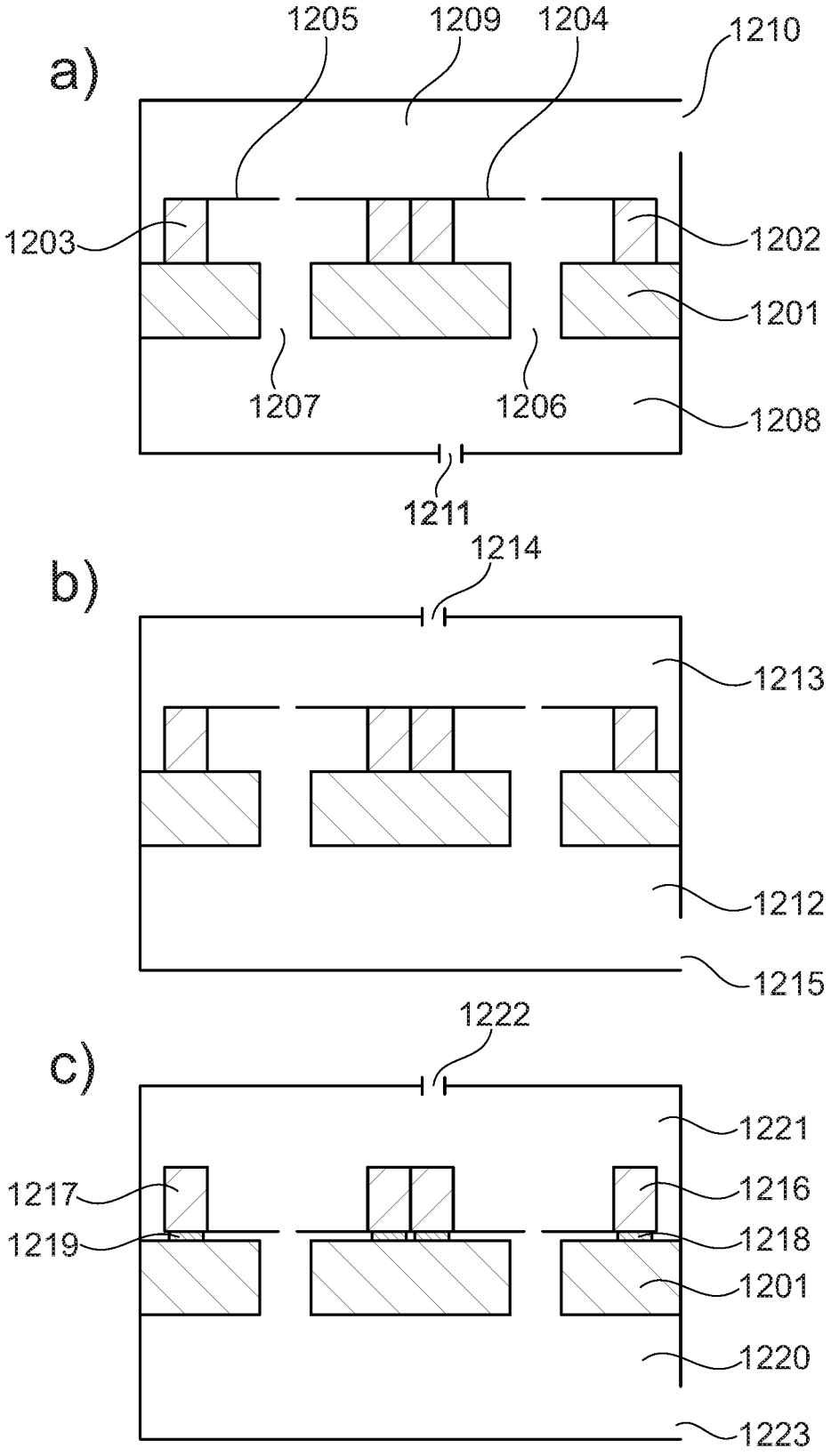
FIG. 12 shows various speaker implementations.

In FIG. 12 three miniature speaker implementations are depicted. In the implementation shown in FIG. 12*a* two MEMS dies 1202, 1203 are arranged on a common PCB 1201 with through-going openings 1206, 1207 provided therein. The through-going openings 1206, 1207 form an acoustical connection between the sound cavities of the MEMS dies 1202, 1203 and the rear volume 1208 having an optional venting opening 1211 through the speaker housing. The MEMS dies 1202, 1203 comprise respective sound cavities with respective cantilever beams 1204, 1205, or rows of cantilever beams, associated therewith. The miniature speaker further comprises a front volume 1209 being acoustically connected to the sound outlet 1210. In the implementation depicted in FIG. 12*b* the miniature speaker comprises a front volume 1212 being acoustically connected to the sound outlet 1215. Moreover, a rear volume 1213 having an optional venting opening 1214 is provided. The arrangement of the MEMS dies and the common PCB is similar to the implementation depicted in FIG. 12*a*. In FIG. 12*c* the two MEMS dies 1216, 1217 are turned upside down with the cantilever beams, or rows of cantilever beams, facing the common PCB 1201. Appropriate flip-chip mounting techniques are applied to properly secure the MEMS dies 1216, 1217 to the common PCB. The speaker implementation depicted in FIG. 12*c* further comprises a rear volume 1221 having an optional venting opening 1222 and a front volume 1220 being acoustically connected to sound outlet 1223. It should be noted that the number of for example MEMS dies, sound cavities, PCBs, front volumes, rear volumes, sound outlets and venting openings may differ from what is depicted in FIG. 12.

The venting openings 1211, 1214, 1222 may, instead of connecting the respective rear volumes 1208, 1213, 1221 to the outside of the miniature speaker, alternatively be provided between the front volumes 1209, 1212, 1220 and the rear volumes 1208, 1213, 1221.

The invention claimed is:

1. A miniature speaker comprising a plurality of sound generating elements, wherein each of the plurality of sound generating elements comprises a sound cavity and a moveable element associated therewith, wherein the moveable element comprises one or more cantilever beams configured to move said moveable element and thus generate sound pressure waves in response to an applied drive signal, wherein a first group of one or more of the plurality of sound generating elements forms part of a first MEMS die, the first MEMS die being arranged on a surface of a first substrate having a plurality of through-going openings arranged therein, wherein the plurality of through-going openings in the first substrate acoustically connect the first group to one or more rear volumes, wherein one or more openings is/are provided between the one or more rear volumes and an exterior volume of the miniature speaker.

2. The miniature speaker according to claim 1, wherein each of the one or more cantilever beams comprises a piezoelectric layer sandwiched between two electrodes configured to receive the applied drive signal.

3. The miniature speaker according to claim 1, wherein the one or more cantilever beams of each of the plurality of sound generating elements form one or more arrays of cantilever beams.

4. The miniature speaker according to claim 1, wherein at least two sound cavities among the plurality of sound cavities have different volumes.

5. The miniature speaker according to claim 1, wherein at least two sound cavities among the plurality of sound cavities are acoustically connected.

6. The miniature speaker according to claim 1, wherein the first substrate comprises a printed circuit board or a flex print, the printed circuit board or the flex print comprising electrical conducting paths configured to lead a drive signal to the first group via the first carrier substrate.

7. The miniature speaker according to claim 1, wherein the plurality of through-going openings in the first substrate acoustically connect the first group to one or more front volumes.

8. The miniature speaker according to claim 7, wherein the plurality of through-going openings in the first substrate acoustically connect the first group to a common front volume, the common front volume being acoustically connected to a sound outlet in a housing of the miniature speaker.

9. The miniature speaker according to claim 1, wherein a second group of one or more of the plurality of sound generating elements forms part of a second MEMS die arranged on a second substrate having a plurality of through-going openings arranged therein, and wherein the plurality of through-going openings of the second substrate are acoustically connected to the second group, and wherein the second substrate comprises a printed circuit board or a flex print comprising electrical conducting paths configured to lead a drive signal to the second group via the second substrate, and wherein the plurality of through-going openings in the first and second substrates are acoustically connected to a common front volume arranged between the first and second substrates, the common front volume being acoustically connected to a sound outlet in a housing of the miniature speaker.

10. A receiver assembly for a hearing device, the receiver assembly comprising a miniature speaker according to claim 1.

11. A receiver-in-canal hearing device, comprising a receiver assembly according to claim 10.

12. The miniature speaker according to claim 1, wherein the one or more cantilever beams is a plurality of cantilever beams.

13. A miniature speaker comprising a plurality of sound generating elements, a first group of which forms part of a MEMS die arranged on a surface of a first substrate having a plurality of through-going openings arranged therein, the plurality of through-going openings being acoustically connected to the first group, wherein each sound generating element of the plurality of sound generating elements includes a sound cavity and a moveable element associated therewith, the moveable element including one or more cantilever beams configured to move said moveable element and thus generate sound pressure waves in response to an applied drive signal, wherein the plurality of through-going openings in the first substrate acoustically connect the first group to one or more rear volumes, and wherein one or more openings is/are provided between the one or more rear volumes and an exterior volume of the miniature speaker.

14. The miniature speaker according to claim 13, wherein the first substrate comprises a printed circuit board or a flex print, the printed circuit board or the flex print comprising electrical conducting paths configured to lead a drive signal to the first group via the first carrier substrate.

15. A miniature speaker comprising a plurality of sound generating elements, wherein each sound generating element includes a sound cavity and a moveable element associated therewith, the moveable element including one or more cantilever beams configured to move said moveable element and thus generate sound pressure waves in response to an applied drive signal, wherein a first group of one or more of the plurality of sound generating elements forms part of a first MEMS die, wherein the first MEMS die is arranged on a surface of a first substrate having a plurality of through-going openings arranged therein, and wherein the plurality of through-going openings are acoustically connected to the first group, wherein a second group of one or more of the plurality of sound generating elements forms part of a second MEMS die arranged on a second substrate having a plurality of through-going openings arranged therein, and wherein the plurality of through-going openings are acoustically connected to the second group, and wherein the plurality of through-going openings in the first and second substrates is acoustically connected to a common front volume arranged between the first and second substrates, the common front volume being acoustically connected to a sound outlet in a housing of the miniature speaker.

16. The miniature speaker of claim 15, wherein the second substrate includes a printed circuit board or a flex print having electrical conducting paths configured to lead a drive signal to the second group via the second substrate.

* * * * *